US010510358B1

(12) United States Patent
Barra-Chicote et al.

(10) Patent No.: US 10,510,358 B1
(45) Date of Patent: Dec. 17, 2019

(54) RESOLUTION ENHANCEMENT OF SPEECH SIGNALS FOR SPEECH SYNTHESIS

(71) Applicant: Amazon Technologies, Inc., Seattle, WA (US)

(72) Inventors: Roberto Barra-Chicote, Seattle, WA (US); Alexis Moinet, Seattle, WA (US); Nikko Strom, Kirkland, WA (US)

(73) Assignee: Amazon Technologies, Inc., Seattle, WA (US)

( * ) Notice: Subject to any disclaimer, the term of this patent is extended or adjusted under 35 U.S.C. 154(b) by 62 days.

(21) Appl. No.: 15/719,950

(22) Filed: Sep. 29, 2017

(51) Int. Cl.

| | |
|---|---|
| ***G10L 21/038*** | (2013.01) |
| ***G10L 19/07*** | (2013.01) |
| ***G10L 21/02*** | (2013.01) |
| ***G10L 13/08*** | (2013.01) |
| ***G10L 25/30*** | (2013.01) |
| ***G10L 13/047*** | (2013.01) |

(52) U.S. Cl.
CPC ..... *G10L 21/0202* (2013.01); *G10L 13/047* (2013.01); *G10L 13/08* (2013.01); *G10L 25/30* (2013.01)

(58) Field of Classification Search
CPC ..... G10L 21/00
USPC ..... 704/235, 255, 259, 260
See application file for complete search history.

(56) References Cited

U.S. PATENT DOCUMENTS 6,658,287 B1 * 12/2003 Litt ..... A61B 5/0476 600/544
9,082,401 B1 * 7/2015 Fructuoso ..... G10L 13/08
9,159,329 B1 * 10/2015 Agiomyrgiannakis ..... G10L 13/06
9,922,641 B1 * 3/2018 Chun ..... G10L 13/033
2005/0057570 A1 * 3/2005 Cosatto et al. ..... G06T 13/40 345/473
2006/0106619 A1 * 5/2006 Iser ..... G10L 21/038 704/500
2014/0236588 A1 * 8/2014 Subasingha et al. ... G10L 19/07 704/219
2015/0073804 A1 * 3/2015 Senior ..... G10L 13/06 704/259
2015/0127350 A1 * 5/2015 Agiomyrgiannakis ..... G10L 13/02 704/266
2015/0348535 A1 * 12/2015 Dachiraju et al. ..... G10L 25/90 704/266
2016/0078859 A1 * 3/2016 Luan ..... G10L 13/033 704/260
2016/0140951 A1 * 5/2016 Agiomyrgiannakis ..... G10L 13/02 704/260

(Continued)

OTHER PUBLICATIONS

Oord, Aaron van den, et al. "Wavenet: A generative model for raw audio." arXiv preprint arXiv:1609.03499 (Year: 2016).*

(Continued)

*Primary Examiner* — Seong-Ah A Shin
(74) *Attorney, Agent, or Firm* — Occhiuti & Rohlicek LLP

(57) ABSTRACT

An approach to speech synthesis uses two phases in which a relatively low quality waveform is computed, and that waveform is passed through an enhancement phase which generates the waveform that is ultimately used to produce the acoustic signal provided to the user. For example, the first phase and the second phase are each implemented using a separate artificial neural network. The two phases may be computationally preferable to using a direct approach to yield a synthesized waveform of comparable quality.

17 Claims, 9 Drawing Sheets

(56) References Cited

U.S. PATENT DOCUMENTS

| | | | | |
|---|---|---|---|---|
| 2016/0189027 | A1* | 6/2016 | Graves | G06N 3/063 706/17 |
| 2016/0379638 | A1* | 12/2016 | Basye | G10L 15/22 704/235 |
| 2018/0114522 | A1* | 4/2018 | Hall | G10L 13/047 |
| 2019/0019500 | A1* | 1/2019 | Jang | G10L 13/04 |

OTHER PUBLICATIONS

Palaz, Dimitri, Ronan Collobert, and Mathew Magimai Doss. "Estimating phoneme class conditional probabilities from raw speech signal using convolutional neural networks." arXiv preprint arXiv:1304.1018 (Year: 2013).*

Oord, Aaron van den, Sander Dieleman, Heiga Zen, Karen Simonyan, Oriol Vinyals, Alex Graves, Nal Kalchbrenner, Andrew Senior, and Koray Kavukcuoglu. "Wavenet: A generative model for raw audio." arXiv preprint arXiv:1609.03499 (2016).

Fisher, Kyle, and Adam Scherlis. "WaveMedic: Convolutional Neural Networks for Speech Audio Enhancement," 2016, 6 pages, Retrieved from cs229.stanford.edu/proj2016/report/FisherScherlis-WaveMedic-project.pdf on Jun. 5, 2017.

Goodfellow, Ian. "NIPS 2016 tutorial: Generative adversarial networks." arXiv preprint arXiv:1701.00160 (2016).

* cited by examiner

RESOLUTION ENHANCEMENT OF SPEECH SIGNALS FOR SPEECH SYNTHESIS

BACKGROUND

This invention relates to speech synthesis, and more particularly to mitigation of amplitude quantization or other artifacts in synthesized speech signals.

One recent approach to computer-implemented speech synthesis makes use of a neural network to process a series of phonetic labels derived from text to produce a corresponding series of waveform sample values. In some such approaches, the waveform sample values are quantized, for example, to 256 levels of a μ-law non-uniform division of amplitude.

DETAILED DESCRIPTION

One or more approaches described below address the technical problem of automated speech synthesis, such as conversion of English text to samples of a waveform that represents a natural-sounding voice speaking the text. In particular, the approaches address improvement of the naturalness of the speech represented in the output waveform, for example, under a constraint of limited computation resources (e.g., processor instructions per second, process memory size) or limited reference data used to configure a speech synthesis system (e.g., total duration of reference waveform data). Very generally, a common aspect of a number of these approaches is that there is a two-part process of generation of an output waveform y(t), which may be a sampled signal at a sampling rate of 16,000 samples per second, with each sample being represented as signed 12-bit or 16-bit integer values (i.e., quantization into $2^{12}$ or $2^{16}$ levels). In the discussion below, a "waveform" should be understood to include a time-sampled signal, which can be considered to be or can be represented as a time series of amplitude values (also referred to as samples, or sample values). Other sampling rates and number of quantization levels may be used, preferably selected such that the sampling rate and/or the number of quantization levels do not contribute to un-naturalness of the speech represented in the output waveform. The first stage of generation of the waveform involves generation of an intermediate waveform x(t), which is generally represented with fewer quantization levels (e.g., resulting in greater quantization noise) and/or lower sampling rate (e.g., resulting in smaller audio bandwidth) than the ultimate output y(t) of the synthesis system. The second stage then transforms the intermediate waveform x(t) to produce y(t). In general, y(t) provides improved synthesis as compared to x(t) in one or more characteristics (e.g., types of degradation) such as perceptual quality (e.g., mean opinion score, MOS), a signal-to-noise ratio, a noise level, degree of quantization, a distortion level, and a bandwidth. While the generation of the intermediate waveform, x(t), is directly controlled by the text that is to be synthesized, the transformation from x(t) to y(t) does not, in general require, direct access to the text to be synthesized.

Figure 1:
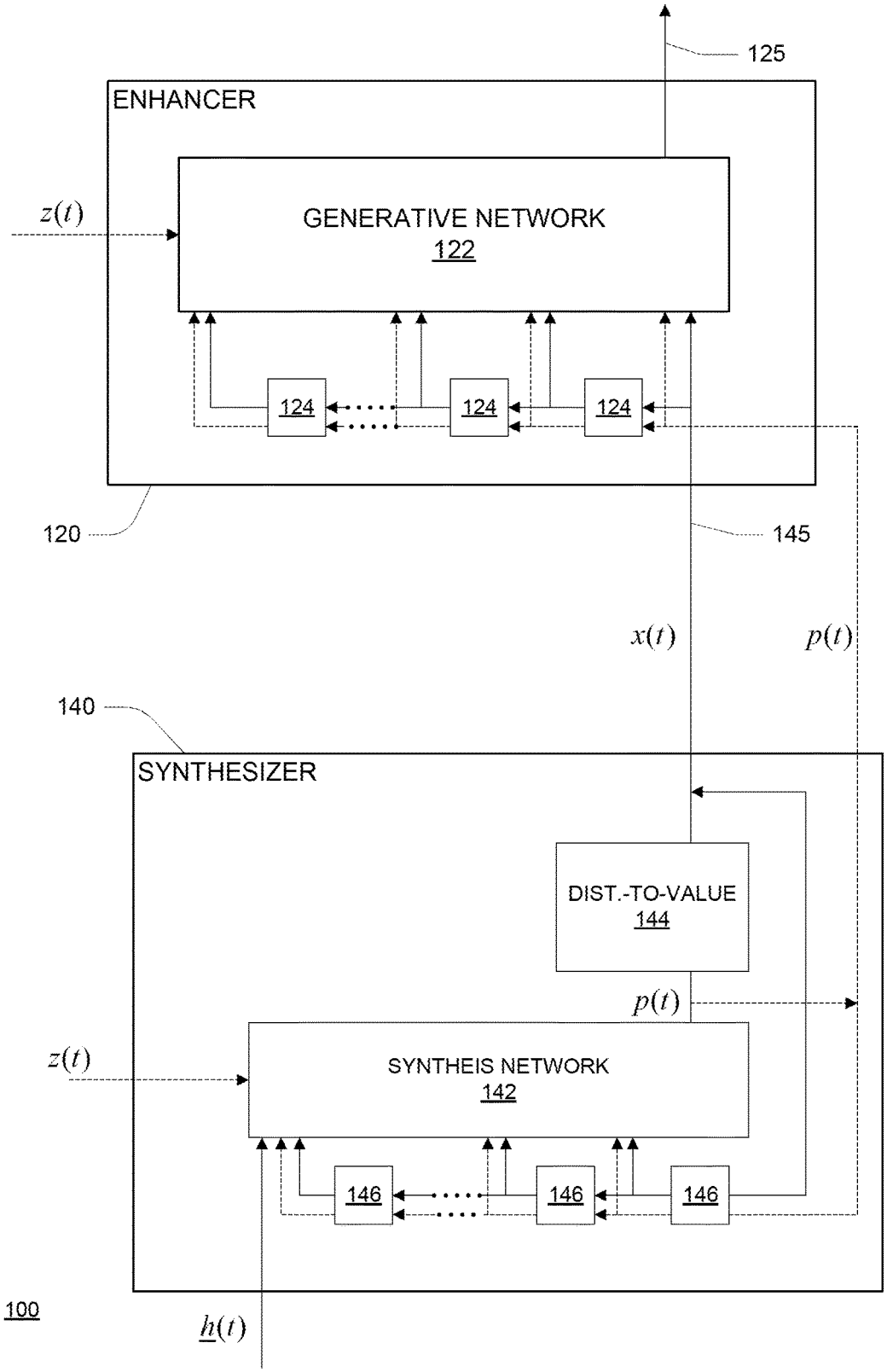
FIG. 1 is a block diagram of a runtime speech synthesis system using quantization enhancement.
Figure 8:
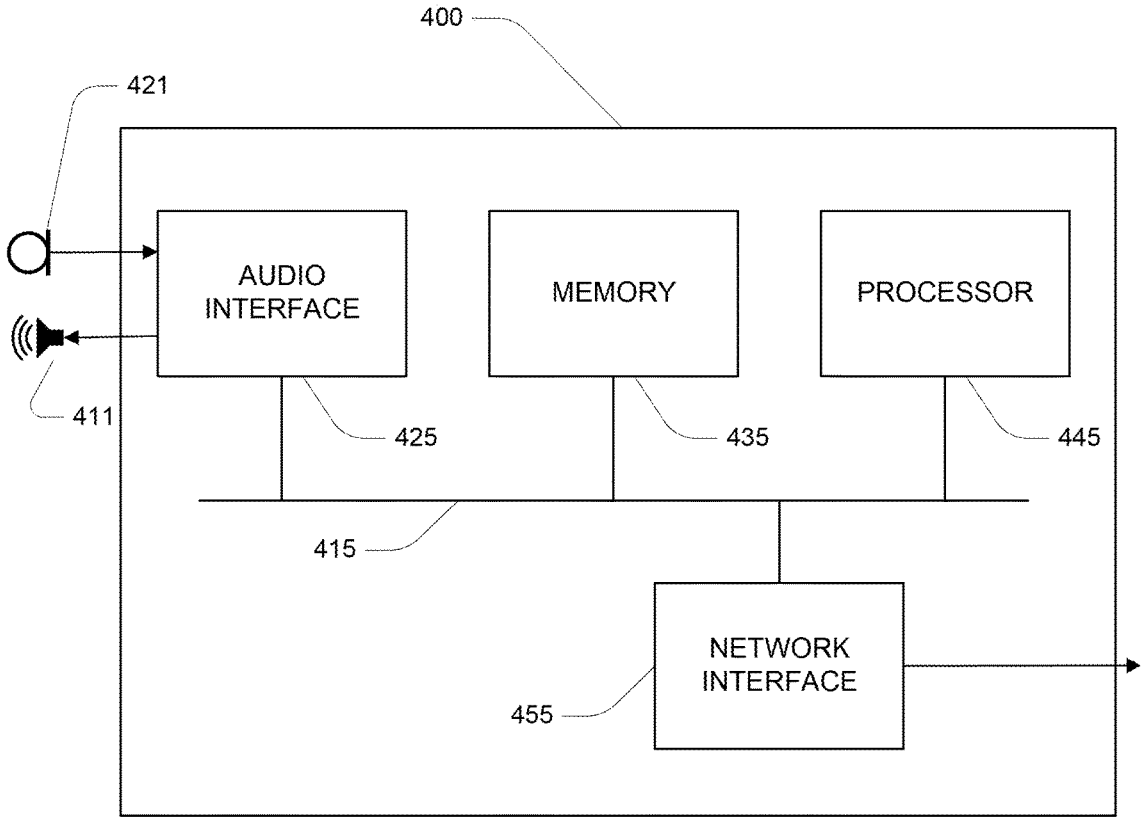
FIG. 8 is a hardware configuration of the audio-based device.
Figure 9:
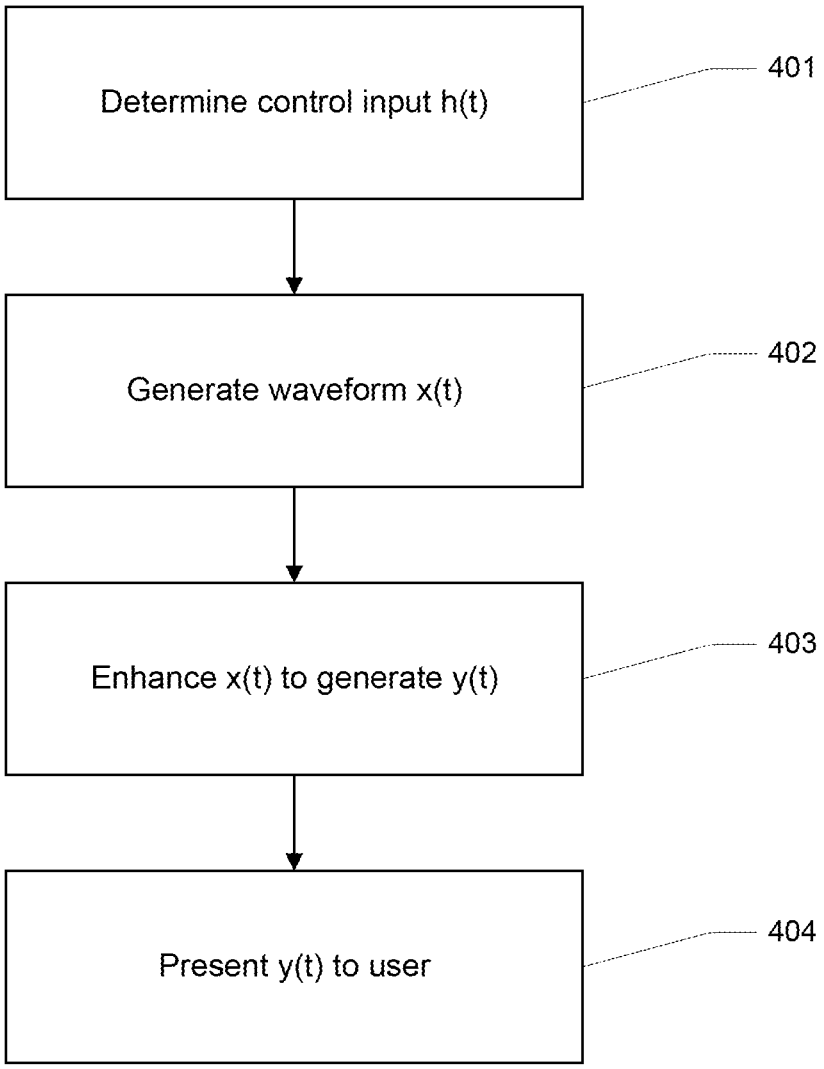
FIG. 9 is a flowchart.

Referring to FIG. 1, as well as to the flowchart of FIG. 8, in an embodiment, a speech synthesis system 100 includes a synthesizer 140, which accepts control values h(t) 148 (which may be scalar or vector numerical and/or categorical quantities representing a linguistic characteristic to be conveyed) for each discrete time sample t (e.g., at a sampling rate of 16 k-samples/second) (step 401), and outputs a quantized waveform sample x(t) for that time (step 402). Although a variety of different forms of control values h(t) may be used, this embodiment uses repetition of a phoneme label determined from a text-to-phoneme conversion, for example, using dictionary lookup of the words or other conventional automated conversion approaches (e.g., using a finite state transducer). That is, the input may be a "one-hot" vector of N indicator values (zero or one) for N different phoneme labels. The duration of the phonemes may be determined by a variety of approaches, for example, based on an average speaking rate that is desired and phoneme-specific durations determined by measurement of representative speech. Note that the approaches described below are largely insensitive to the particular form of the control values, which may alternatively be, for instance, vectors of indicators of phoneme pairs, context-dependent phonemes (e.g., phoneme, syllable, and/or word context), or acoustic-linguistic characteristics (e.g., manner, place of articulation, voicing, continuants versus non-continuants).

In the system illustrated in FIG. 1, waveform samples are quantized to 256 levels in a non-uniform μ-Law quantization approach. Although the waveform x(t) may be suitable for presentation via a speaker as an acoustic signal to a user, artifacts introduced by the synthesizer 140 may not provide a desired degree of signal quality, for example, based on a user's perception of naturalness or noisiness. In particular, the synthesizer 140 introduces quantization noise or other distortion in the output, which may contribute to reduced signal quality.

In the system 100 of FIG. 1, rather than using the synthesizer output x(t) directly, the time samples of x(t) are passed through an enhancer 120, which produces corresponding enhanced time samples y(t) (step 403). Very generally, the enhancer 120 produces each time sample y(t) as a parameterized non-linear transformation of a history of the input samples x(t). As discussed more fully below, the parameters of the enhancer 120 are trained on a reference waveform dataset. The enhanced time samples y(t) are used for presentation via a speaker as an acoustic signal to a user (step 404).

Although the enhancer 120 is applicable to a variety of synthesizer types, the synthesizer 140 shown in FIG. 1 makes use of a waveform synthesis approach in which a synthesis network 142 outputs $\underline{p}(t)$ 143 at a time t representing a probability distribution of a waveform sample amplitude for that time over a discrete set of ranges of amplitudes. As introduced above, this set of ranges are non-uniform in amplitude correspond to μ-Law quantization, in this embodiment with 256 ranges. That is, the synthesis network 142 in this case has 256 outputs, each providing a real value in a range 0.0 to 1.0 and summing to 1.0. This distribution output is passed through a distribution-to-value converter 144 which outputs a single real-valued (e.g., floating point value) waveform amplitude based on the distribution, in this example, providing a quantized value representing the range of amplitudes with the highest probability. The output of the distribution-to-value converter 144 is the output of the synthesizer 140, which is passed to the enhancer 120. In this embodiment, the output x(t) is therefore a quantized waveform quantized to one of the 256 levels represented in the distribution p(t) that is output from the synthesis network 142. In alternative embodiments, the distribution-to-value converter 144 may perform some degree of smoothing or interpolation by which a time range of distributions may be used together to determine the sample value x(t) that is output, and/or x(t) may represent an interpolation between quantization values, for example, an expected value derived from the probability distribution. In such embodiments, the values of the samples of x(t) are not necessarily quantized to one of the 256 amplitude values, nevertheless the signal x(t) will generally exhibit quantization-related degradation (e.g., quantization noise) related to the number of quantization levels represented in the distribution p(t).

The synthesis network 142 includes a parameterized non-linear transformer (i.e., a component implementing a non-linear transformation) that processes a series of past values of the synthesizer output, x(t−1), . . . , x(t−T), internally generated by passing the output through a series of delay elements 146, denoted herein as $\underline{x}(t-1)$, as well as the set of control values h(t) 148 for the time t, and produces the amplitude distribution $\underline{p}(t)$ 143 for that time. In one example of a synthesis network 142, a multiple layer artificial neural network (also equivalently referred to as "neural network", ANN, or NN below) is used in which the past synthesizer values are processed as a causal convolutional neural network, and the control value is provided to each layer of the neural network.

In some examples of the multiple-layer synthesis neural network, an output vector of values y from the $k^{th}$ layer of the network depends on the input x from the previous layer (or the vector of past sample values for the first layer), and the vector of control values h as follows:

$$y=\tan h(W_{k,f}*x+V_{k,f}^{T}h)\odot\sigma(W_{k,g}*\xi+V_{k,g}^{T}h)$$

where $W_{k,f}$, $W_{k,g}$, $V_{k,f}$, and $V_{k,g}$ are matrices that hold the parameters (weights) for the $k^{th}$ layer of the network, σ( ) is a nonlinearity, such as a rectifier non-linearity or a sigmoidal non-linearity, and the operator ⊙ represents an elementwise multiplication. The parameters of the synthesis network are stored (e.g., in a non-volatile memory) for use by the multiple-layer neural network structure of the network, and impart the synthesis functionality on the network.

As introduced above, the enhancer 120 accepts successive waveform samples x(t) and outputs corresponding enhanced waveform samples y(t). The enhancer includes an enhancement network 122, which includes a parameterized non-linear transformer that processes a history of inputs $\underline{x}(t)=(x(t), x(t-1), \ldots, x(t-T))$, which are internally generated using a series of delay elements 124, to yield the output y(t) 125.

In one embodiment, with the sampling rate for x(t) and y(t) being the same, the enhancer 120 has the same internal structure as the synthesis network 142, except that there is no control input h(t) and the output is a single real-value quantity (i.e., there is a single output neural network unit), rather than there being one output per quantization level as with the synthesis network 142. That is, the enhancement network forms a causal (or alternatively non-causal with look-ahead) convolutional neural network. If the sampling rate of y(t) is higher than x(t), then additional inputs may be formed by repeating or interpolating samples of x(t) to yield a matched sampling rate. The parameters of the enhancer are stored (e.g., in a non-volatile memory) for use by the multiple-layer neural network structure of the network, and impart the enhancement functionality on the network.

The enhancement network 122 and synthesis network 142 have optional inputs, shown in dashed lines in FIG. 1. For example, the distribution p(t) may be fed back directly from the output to the input of the synthesis network 142, without passing through the distribution-to-value element 144. Similarly, this distribution may be passed to the enhancement network 122 as well. When the distribution p(t) is passed in this way, passing x(t) is not essential. Furthermore, the enhancement network 122 and/or the synthesis network 142 may have a "noise" input z(t) which provides a sequence of random values from a predetermined probability distribution (e.g., a Normal distribution), thereby providing a degree of random variation in the synthesis output, which may provide increased naturalness of the resulting signal provided to the user.

Figure 2:
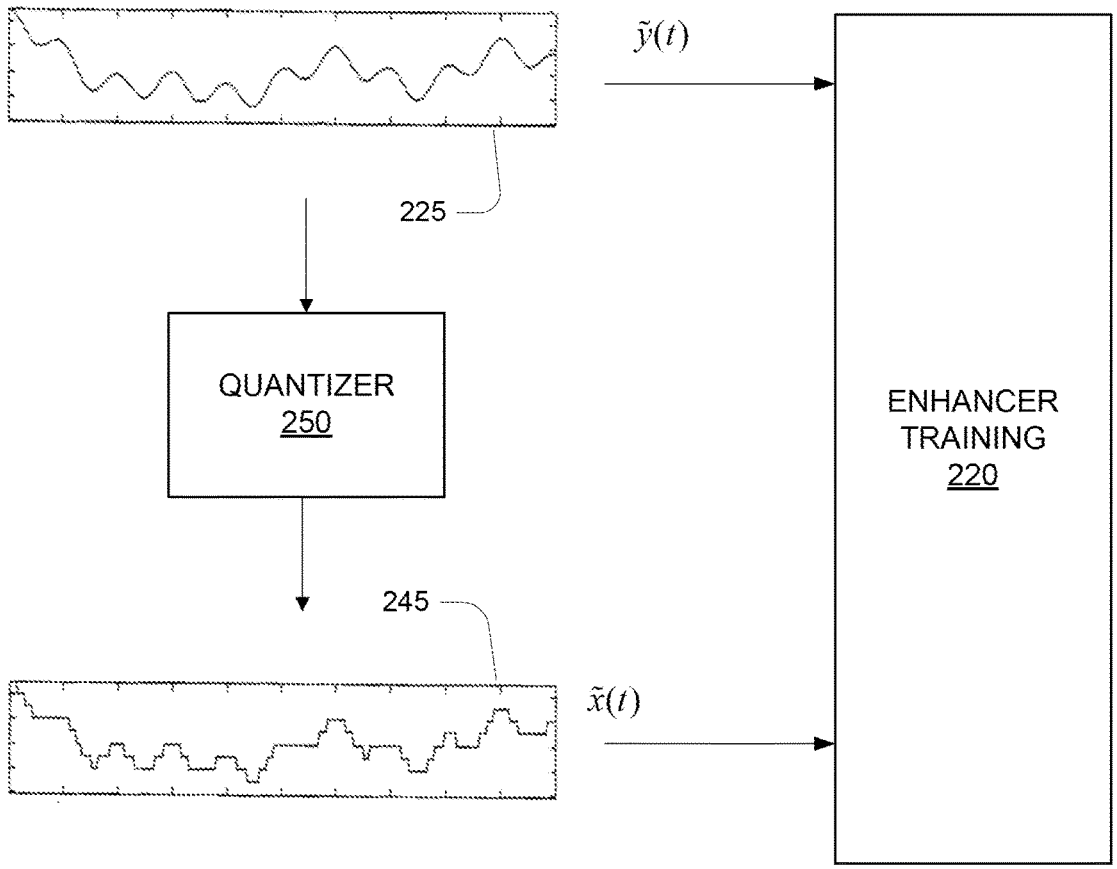
FIG. 2 is a diagram illustrating a first training approach.

Referring to FIG. 2, one approach to determining the parameter values (i.e., the neural network weights) of the enhancer 120, referred to herein as "training," makes use of a reference waveform 225 ($\tilde{y}(t)$), or equivalently a set of such waveforms. This waveform is passed through a quantizer 230 to produce a quantized reference waveform 245 ($\tilde{x}(t)$), where the characteristics of the quantizer 245 such as the number and boundaries of the quantization ranges match the output of the synthesizer 140. For example, the reference waveform 225 may be quantized with a 12-bit or 16-bit linear quantizer, and the quantized reference waveform 245 may be quantized with an 8-bit μ-law quantizer. The paired waveforms $\tilde{y}(t)$ and $\tilde{x}(t)$ are provided to an enhancer trainer 220, which determines the parameters of the enhancement network 122 (see FIG. 1), to best predict the samples of $\tilde{y}(t)$ from the quantized samples of $\tilde{x}(t)$ according to a mean-squared-error loss function. In some examples, the enhancement network is trained using a gradient-based iterative update procedure (e.g., Back-Propagation), although a variety of other parameter optimization approached may be used to determine parameters of the enhancement network (e.g., stochastic gradient).

Figure 3:
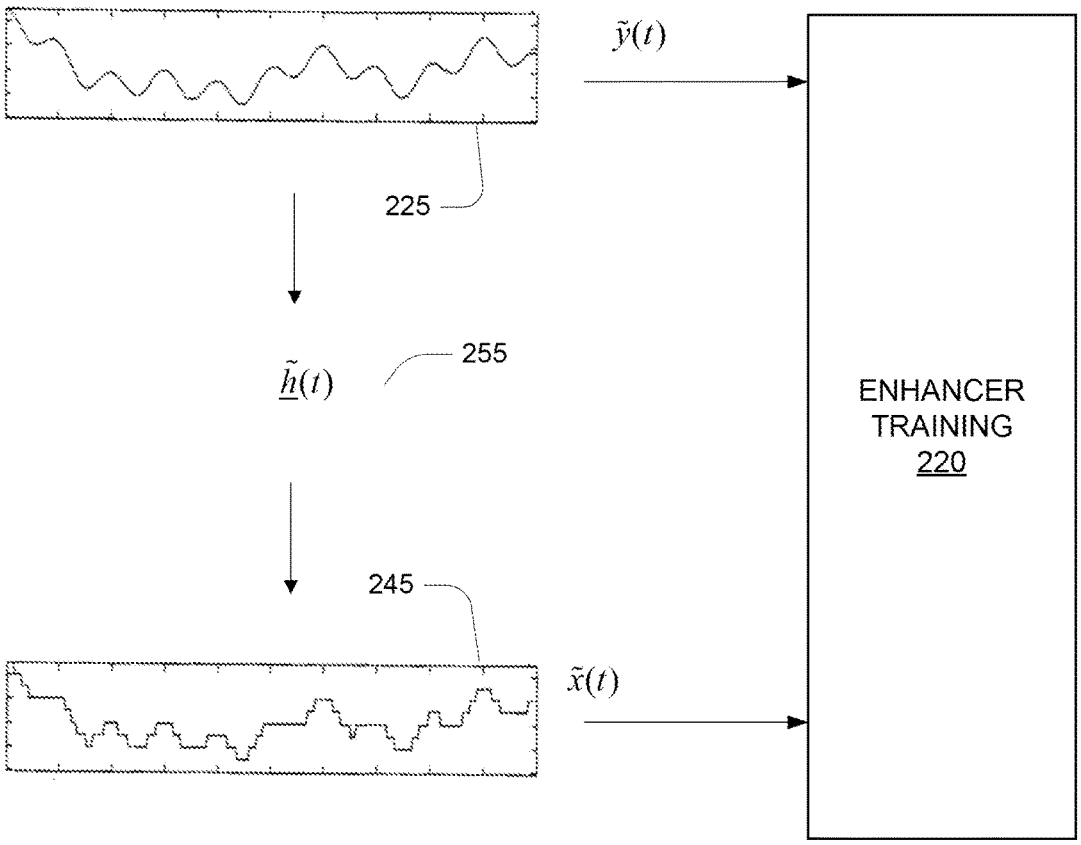
FIG. 3 is a diagram illustrating a second training approach.

Referring to FIG. 3, another training approach uses also the reference waveform $\tilde{y}(t)$. However, rather than quantizing the waveform samples directly, a two-step procedure is used to determine the paired waveform $\tilde{x}(t)$. The waveform $\tilde{y}(t)$ is processed using a speech recognizer to determine a sequence of control values $\tilde{h}(t)$ corresponding to that waveform. For example, a forced phonetic alignment to a manual transcription using a phonetic or word-based speech recognizer is performed on the waveform (although alternatively unconstrained recognition may be used if there is no manual alignment). The phonetic alignment output from the speech recognizer is then used to produce the control values, for example, by labelling each time sample with the phoneme identified by the speech recognizer as being produced at that time. The control values $\tilde{h}(t)$ are passed through a configured synthesizer 140 to produce the waveform values $\tilde{x}(t)$. With these paired waveforms ($\tilde{y}(t)$, $\tilde{x}(t)$), training of the parameters of the enhancement network 122 proceeds as with the training approach illustrated in FIG. 2.

In yet another training approach, the parameters of the enhancer 120 and the synthesizer 140 are trained together. For example, the synthesizer 140 and the enhancer 120 are individually trained using an approach described above. As with the approach for training the enhancer 120 illustrated in FIG. 3, a training waveform $\tilde{y}(t)$ is recognized to yield a control input $\tilde{h}(t)$ for the synthesizer 140. The entire speech synthesis system 100 illustrated in FIG. 1 is treated as a combined neural network, which is trained such that the output $\tilde{\tilde{y}}(t)$ from the enhancer 120 with $\tilde{h}(t)$ input to the synthesizer 140 matched the original training waveform $\tilde{y}(t)$ according to a loss-function, such as to minimize a mean-squared-error function. In order to propagate parameter incrementing information via the distribution-to-value element 144, a variational approach is in which a random noise value is added to x(t), thereby permitting propagation of gradient information into the synthesis network 142 to affect the incremental updates of the parameters of the synthesis network. Note that in this approach, after the joint training, the intermediate waveform x(t) that is passed from the synthesizer 140 to the enhancer 120, is not necessarily suitable for being played to a listener as an audio waveform as the joint training does not necessarily preserve that aspect of the synthesizer.

In yet another training approach, a "Generative Adversarial Network" (GAN) is used. In this approach, the enhancement network 122 is trained such that resulting output waveforms (i.e., sequences of output samples y(t)) are indistinguishable from true waveforms. In general terms, a GAN approach makes use of a "generator" G(z), which processes a random value z from a predetermined distribution p(z) (e.g., a Normal distribution) and outputs a random value x. For example, G is a neural network. The generator G is parameterized by parameters $\theta^{(G)}$, and therefore the parameters induce a distribution p(y). Very generally, training of G (i.e., determining the parameter values $\theta^{(G)}$) is such that p(y) should be indistinguishable from a distribution observed in a reference (training) set. To achieve this criterion, a "discriminator" D(y) is used which outputs a single value d, in the range [0,1] indicating the probability that the input x is an element of the reference set or is an element randomly generated by G. To the extent that the discriminator cannot tell the difference (e.g., the output d is like flipping a coin), the generator G has achieved the goal of matching the generated distribution p(y) to the reference data. In this approach, the discriminator D(x) is also parameterized with parameters $\theta^{(D)}$, and the parameters are chosen to do as good a job as possible in the task of discrimination. There are therefore competing (i.e., "adversarial") goals: $\theta^{(D)}$ values are chosen to make discrimination as good as possible, while $\theta^{(G)}$ values are chosen to make it as hard as possible for the discriminator to discriminate. Formally, these competing goals may be expressed using an objective function $$J^{(D)}(\theta^{(D)}, \theta^{(G)}) = \frac{1}{2}Ave_y(-\log(D(y))) + \frac{1}{2}Ave_z(-\log(1 - D(G(z))))$$

where the averages are over the reference data (x) and over a random sampling of the known distribution data (z). Specifically, the parameters are chosen according to the criterion $$\min_{\theta^{(G)}} \max_{\theta^{(D)}} J^{(D)}(\theta^{(D)},\theta^{(G)}).$$

In the case of neural networks, this criterion may be achieved using a gradient descent procedure, essentially implemented as Back Propagation.

Figure 4:
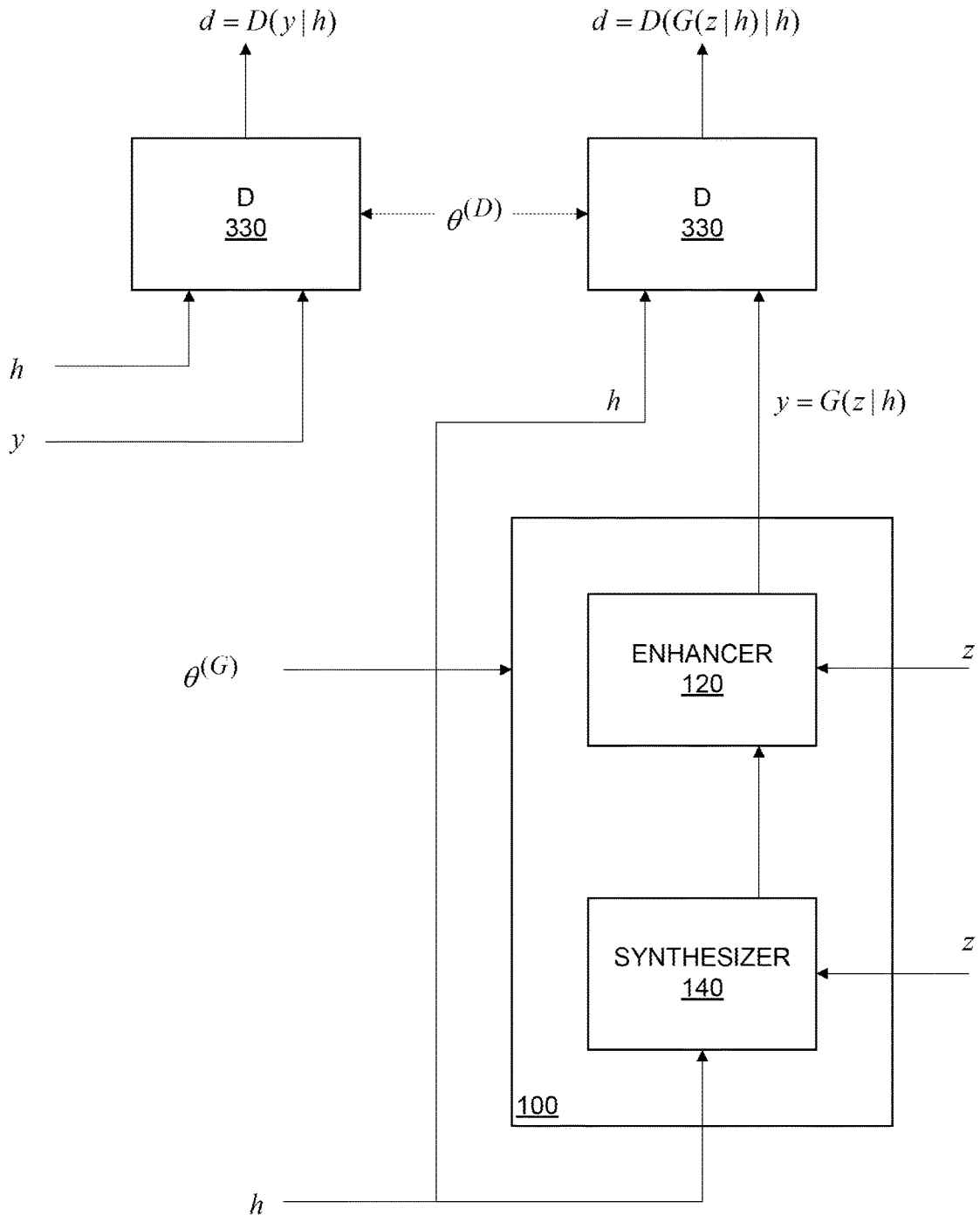
FIG. 4 is a diagram of a third training approach.

Referring to FIG. 4, in some versions of GAN training, the output x is conditioned on a control input h, such that the generator is a function of both z and h, expressed as G(z|h), and the discriminator is provided with that same control input, expressed as D(y|h). The reference data includes true (h, y) pairs. The GAN approach therefore aims to match the conditional distributions of x conditioned on h. In the left-hand part of the figure, the use of the discriminator 330 to compute D(y|h) for a reference waveform is shown, while in the right-hand part the use of the synthesis system and the discriminator 330 to computer D(G(z|h)|h) is shown. These two paths are used to compute the two averages, respectively, in the expression for $J^{(D)}(\theta^{(D)},\theta^{(G)})$ presented above.

Turning to the specific use of the GAN approach to determine the values of the parameters of the enhancement network 122, the role of the generator G is served by the combination of the synthesizer 140 and enhancement network 120, as shown in FIG. 1, with the control input h to G being a sequence of control inputs h(t) for an utterance to be synthesized, the random input z also being a sequence of independently drawn random values, and the output y corresponding to the sequence y(t) output from the enhancer. In at least one embodiment, the parameters $\theta^{(G)}$ are the parameters of the enhancement network 122, with the parameters of the synthesizer 140 being treated as fixed. In an alternative embodiment, the parameters $\theta^{(G)}$ further include parameters of the synthesizer permitting joint training of the enhancement network and the synthesizer. Note that for GAN training, the noise inputs z(t) are provided to the enhancement network, and The discriminator D(y|h) can have a variety of forms, for example, being a recurrent neural network that accepts the sequences y(t) and h(t) and ultimately at the end of the sequence provides the single scalar output d indicating whether the sequence y(t) (i.e., the enhanced synthesized waveform) if a reference waveform or a synthesized waveform corresponding to the control sequence h(t)). The parameters of the neural network of the discriminator D has parameters $\theta^{(D)}$. Consistent with the general GAN training approach introduced above, the determination of the parameter values is performed over mini-batches of reference and synthesized utterances.

Alternative embodiments may differ somewhat from the embodiments described above without deviating from the general approach. For example, the output of the synthesis network 142 may be fed directly to the enhancer 120 without passing through a distribution-to-value converter 144. As another example, rather than passing delayed values of x(t) to the synthesis network 142, delayed values of y(t) may be used during training as well as during runtime speech synthesis. In some embodiments, the enhancer 120 also makes use of the control values h(t), or some reduced form of the control values, in addition to the output from the synthesizer 140. Although convolutional neural networks are used in the synthesis network 142 and enhancement network 122 described above, other neural network structures (e.g., recurrent neural networks) may be used. Furthermore, it should be appreciated that neural networks are only one example of a parameterized non-linear transformer, and that other transformers (e.g., kernel-based approaches, parametric statistical approaches) may be used without departing from the general approach.

Figure 5:
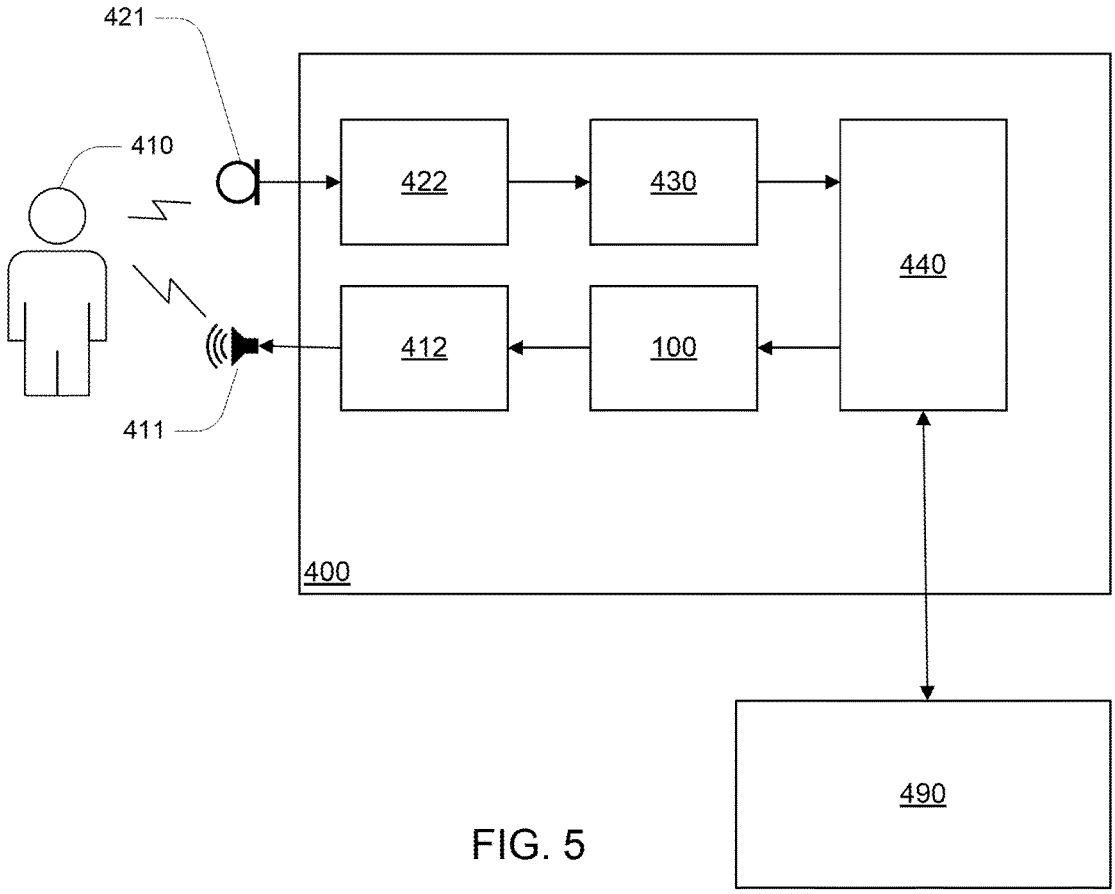
FIG. 5 is a diagram of an audio-based device incorporating the speech synthesis system.

Referring to FIG. 5, one application of the speech synthesis system 100 is in a speech-enabled device 400, which provides speech-based input and output capabilities so that a user 410 is able to interact with the system by voice. For example, the device 400 has one or more microphones 421 and one or more speakers 411 (or is coupled over a communication network or other link to such microphones and speakers). The device includes an input section of an acoustic front end 422, which processes the microphone signals, and provides the signals to a speech recognition system 430. For example, the input section 422 performs various functions such as analog-to-digital conversion (ADC), gain control, beam forming with signals from multiple microphones, noise cancellation, and the like. In some implementations, the device 400 is placed in an environment, such as a room of the user's home, and the device continually monitors the acoustic environment. In such an arrangement, the speech recognition system 430 includes a wake-word detector, which determines when the user has uttered a predefined word or phases ("wake" words). The presence of such a word or phrase signals that the user intends to interact with the device, for example, by issuing a command that will be processed via the device. The speech recognition system 430 may also include, or alternatively accesses over a communication network, a large-vocabulary speech recognition system that determines the particular words uttered by the user. These words (or similar representation, such as a graph or lattice or n-best list) are passed to a processing system 440, which acts on the words spoken by the user. For example, the system 440 includes a natural language processing component that interprets the meaning of the user's utterance. In some situations, the system 440 interacts with a remote computing system 490 over a communication link 495 (e.g., over the Internet), to act on the user's command or to further interpret the user's intent. In response to certain inputs from the user, the processing system 440 determines that a spoken output should be presented to the user via the speaker 411. To do this, the processing system 440 forms a control signal h(t), for example, representing phoneme labels as a function of time corresponding to the words of the spoken output to be presented to the user. The system 440 passes this control signal to the speech synthesis system 100, which in turn generates the corresponding digital audio waveform y(t) for presentation to the user. This waveform is passed via an output section of an acoustic front end 412 to the speaker 411, causing the audio signal to be passed as an acoustic signal to the user 410, who perceives spoken words in the signal. The acoustic front end 412 may perform various functions including digital-to-analog conversion (DAC), automatic gain control, amplitude compression, directional output beamforming, and the like. Note that the parameters of the speech synthesizer 100 may be fixed at the time the device is originally manufactured or configured, and the parameter values may be updated from time to time. For example, the parameter values may be received via a computer network from a server (e.g., a provisioning server), and stored in non-volatile memory in the device 400, thereby imparting specific functionality to the speech synthesizer. In some example, multiple set of parameter values may be stored in or available for downloading to the device, with each set of parameters providing a different character of voice output (e.g., a male versus a female voice).

Figure 6:
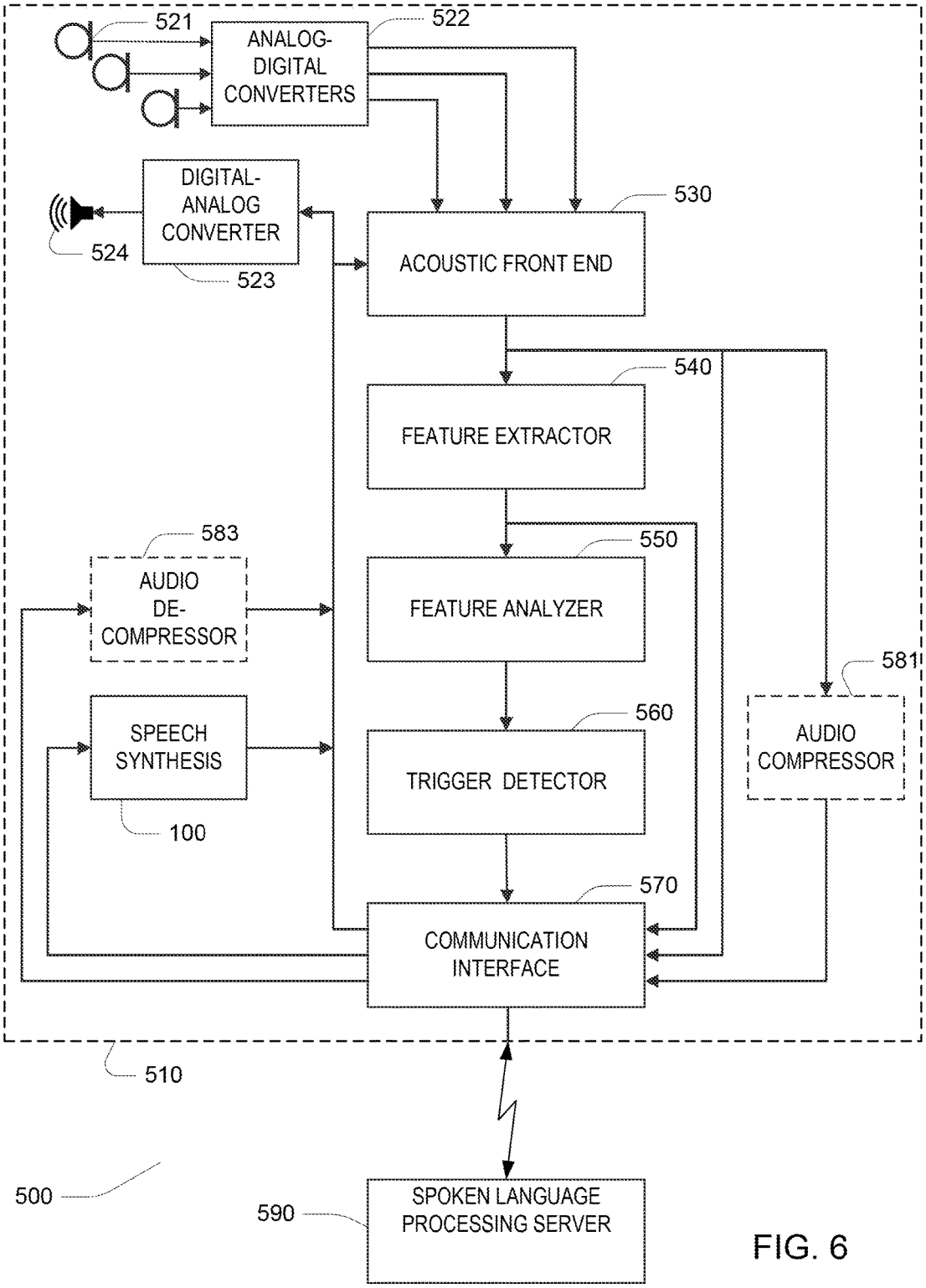
FIGS. 6-7 are a block diagram a speech enabled system

Referring to FIG. 6, in another example an interactive system 500, which makes use of the techniques described above, includes an audio user interface device 510 and a spoken language processing system 590, which is generally distant from the device 510 and in data communication with the device over a network, for instance over the public Internet. The user interface device 510 includes one or more microphones 521, which sense an acoustic environment in which the device 510 is placed. For example, the device 510 may be placed in a living room of a residence, and the microphones acquire (i.e., sense) an acoustic signal in the environment and produce corresponding analog or digital signals, where the acoustic signal may include speech and non-speech sounds. Users in the environment may interact with the system 500. One way for a user to indicate to the system that he or she wishes to interact is to speak a trigger (where "trigger" is used to denote something that initiates a process or reaction), where the trigger may be a predetermined word or phrase (which may be referred to as a "wakeword", or a "trigger word") or some other acoustically distinct event. This trigger is detected by the device 510, and upon detection of the trigger at a particular time (e.g., a time instance or interval), the device passes audio data (e.g., a digitized audio signal or some processed form of such a signal) to a spoken language processing server 590. The device 510 selects a part of the audio data corresponding to a time including an interval of the acoustic signal from a starting time and an ending time, for example, based on an estimate of the time that the trigger began in the acoustic signal and based on a determination that input speech in the acoustic signal has ended. This server processes and interprets the user's acoustic input to the device 510 (i.e., the user's speech input) and generally provides a response to the device for presentation to the user. The presentation of the response may in the form of audio presented via a speaker 524 in the device.

In FIG. 6, the communication interface 570 may receive information for causing the audio output to the user. For example, the interface may receive the phoneme sequence which is presented as the control signal to the speech synthesis system 100, implemented in the user interface device. Operating as described above, the speech synthesis system computes the output waveform, which is passed to the digital-to-analog converter 523, causing acoustic output via the speaker. In an alternative embodiment (not illustrated), the speech synthesis system 100 may be hosted in the spoken language processing system 590 (or yet another server), and the communication interface may receive the computed waveform for presentation via the digital-to-analog converter 523 and speaker 524. In some embodiments, the waveform may be compressed, and the compressed waveform is received at the communication interface 570 and passed via an audio de-compressor 583 prior to digital-to-analog conversion.

Returning to the processing of an input utterance by the user, there are several stages of processing that ultimately yield a trigger detection, which in turn causes the device 510 to pass audio data to the server 590. The microphones 521 provide analog electrical signals that represent the acoustic signals acquired by the microphones. These electrical signals are time sampled and digitized (e.g., at a sampling rate of 20 kHz and 56 bits per sample) by analog-to-digital converters 522 (which may include associated amplifiers, filters, and the like used to process the analog electrical signals). As introduced above, the device 510 may also provide audio output, which is presented via a speaker 524. The analog electrical signal that drives the speaker is provided by a digital-to-analog converter 523, which receives as input time sampled digitized representations of the acoustic signal to be presented to the user. In general, acoustic coupling in the environment between the speaker 524 and the microphones 521 causes some of the output signal to feed back into the system in the audio input signals.

An acoustic front end (AFE) 530 receives the digitized audio input signals and the digitized audio output signal, and outputs an enhanced digitized audio input signal (i.e., a time sampled waveform). An embodiment of the signal processor 530 may include multiple acoustic echo cancellers, one for each microphone, which track the characteristics of the acoustic coupling between the speaker 524 and each microphone 521 and effectively subtract components of the audio signals from the microphones that originate from the audio output signal. The acoustic front end 530 also includes a directional beamformer that targets a user by providing increased sensitivity to signal that originate from the user's direction as compared to other directions. One impact of such beamforming is reduction of the level of interfering signals that originate in other directions (e.g., measured as an increase in signal-to-noise ratio (SNR)).

In alternative embodiments, the acoustic front end 530 may include various features not described above, including one or more of: a microphone calibration section, which may reduce variability between microphones of different units; fixed beamformers, each with a fixed beam pattern from which a best beam is selected for processing; separate acoustic echo cancellers, each associated with a different beamformer; an analysis filterbank for separating the input into separate frequency bands, each of which may be processed, for example, with a band-specific echo canceller and beamformer, prior to resynthesis into a time domain signal; a dereverberation filter; an automatic gain control; and a double-talk detector.

A second stage of processing converts the digitized audio signal to a sequence of feature values, which may be assembled in feature vectors. A feature vector is a numerical vector (e.g., an array of numbers) that corresponds to a time (e.g., a vicinity of a time instant or a time interval) in the acoustic signal and characterizes the acoustic signal at that time. In the system shown in FIG. 5, a feature extractor 540 receives the digitized audio signal and produces one feature vector for each 10 milliseconds of the audio signal. In this embodiment, the element of each feature vector represents the logarithm of the energy in an audio frequency band ("log frequency band energies" LFBE), the frequency bands (e.g., frequency bands spaced uniformly in a Mel frequency scale) together spanning the typical frequency range of speech. Other embodiments may use other representations of the audio signal, for example, using Cepstral coefficients of Linear Prediction Coding (LPC) coefficients rather than LFBEs.

The normalized feature vectors are provided to a feature analyzer 550, which generally transforms the feature vectors to a representation that is more directly associated with the linguistic content of the original audio signal. For example, in this embodiment, the output of the feature analyzer 550 is a sequence of observation vectors, where each entry in a vector is associated with a particular part of a linguistic unit, for example, part of an English phoneme. For example, the observation vector may include 3 entries for each phoneme of a trigger word (e.g., 3 outputs for each of 6 phonemes in a trigger word "Alexa") plus entries (e.g., 2 entries or entries related to the English phonemes) related to non-trigger-word speech. In the embodiment shown in FIG. 5, feature vectors are provided to the feature analyzer 550 at a rate of one feature vector every 10 milliseconds, and an observation vector is provided as output at a rate of one observation vector every 10 milliseconds. In general, an observation vector produced by the feature analyzer 550 may depend on not only a current feature vector, but may also depend on a history of feature vectors, for example, on 31 most recent feature vectors (e.g., with the output being delayed by 10 vectors relative to the current feature vector, the 31 vectors include 10 vectors in the "future" relative to the delayed time, and 20 frames in the "past" relative to the delayed time).

Various forms of feature analyzer 550 may be used. One approach uses probability models with estimated parameters, for instance, Gaussian mixture models (GMMs) to perform the transformation from feature vectors to the representations of linguistic content. Another approach is to use an Artificial Neural Network (ANN) to perform this transformation. Within the general use of ANNs, particular types may be used including Recurrent Neural Networks (RNNs), Deep Neural Networks (DNNs), Time Delay Neural Networks (TDNNs), and so forth. Yet other parametric or non-parametric approaches may be used to implement this feature analysis. In the embodiment described more fully below, a variant of a TDNN is used.

The communication interface receives an indicator part of the input (e.g., the frame number) corresponding to the identified trigger. Based on this identified part of the input, the communication interface 570 selects the part of the audio data (e.g., the sampled waveform) to send to the server 590. In some embodiments, this part that is sent starts at the beginning of the trigger, and continues until no more speech is detected in the input, presumably because the user has stopped speaking. In other embodiments, the part corresponding to the trigger is omitted from the part that is transmitted to the server. However, in general, the time interval corresponding to the audio data that is transmitted to the server depends on the time interval corresponding to the detection of the trigger (e.g., the trigger starts the interval, ends the interval, or is present within the interval).

Figure 7:
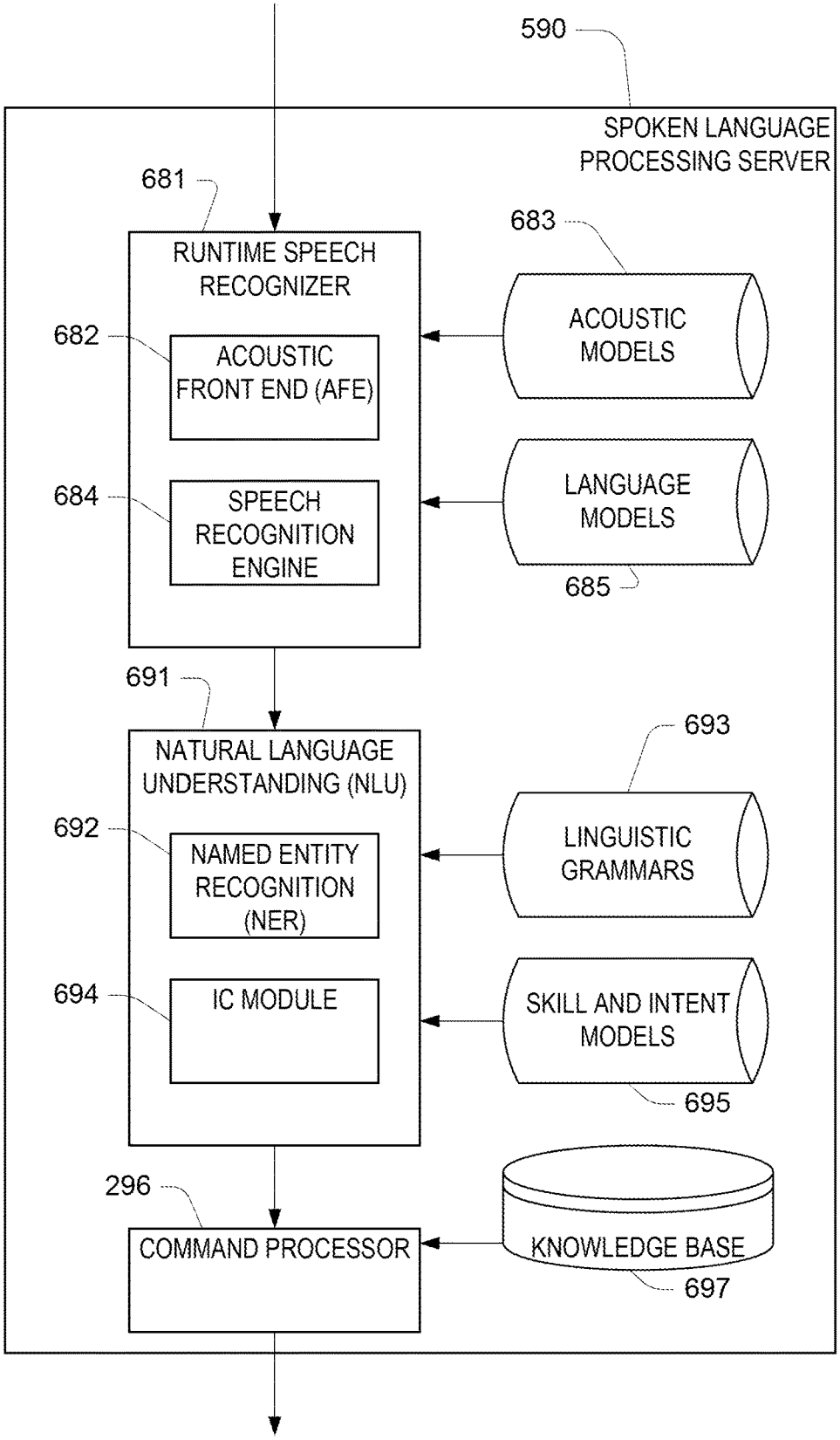

Referring to FIG. 7 processing at the spoken language server 590 may include various configurations for processing the acoustic data (e.g., the sampled audio waveform) received from the audio interface device 510. For example, a runtime speech recognizer 681 uses an acoustic front end 682 to determine feature vectors from the audio data. These may be the same feature vectors computed at the interface device 510, or may be a different representation of the audio data (e.g., different numbers of features, different number per unit time, etc.). A speech recognition engine 682 processes the feature vectors to determine the words in the audio data. Generally, the speech recognizer 681 attempts to match received feature vectors to language phonemes and words as known in the stored acoustic models 683 and language models 685. The speech recognition engine 684 computes recognition scores for the feature vectors based on acoustic information and language information and provides text as output. The speech recognition engine 684 may use a number of techniques to match feature vectors to phonemes, for example using Hidden Markov Models (HMMs) to determine probabilities that feature vectors may match phonemes. Sounds received may be represented as paths between states of the HMM and multiple paths may represent multiple possible text matches for the same sound.

Following processing by the runtime speech recognizer 681, the text-based results may be sent to other processing components, which may be local to the device performing speech recognition and/or distributed across data networks. For example, speech recognition results in the form of a single textual representation of the speech, an N-best list including multiple hypotheses and respective scores, lattice, etc. may be sent to a natural language understanding (NLU) component 691 may include a named entity recognition (NER) module 692, which is used to identify portions of text that correspond to a named entity that may be recognizable by the system. An intent classifier (IC) module 694 may be used to determine the intent represented in the recognized text. Processing by the NLU component may be configured according to linguistic grammars 693 and/or skill and intent models 695. After natural language interpretation, a command processor 696, which may access a knowledge base 697, acts on the recognized text. For example, the result of the processing causes an appropriate output to be sent back to the user interface device for presentation to the user.

The command processor 696 may determine word sequences (or equivalent phoneme sequences, or other control input for a synthesizer) for presentation as synthesized speech to the user. The command processor passes the word sequence to the communication interface 570, which in turn passes it to the speech synthesis system 100. In an alternative embodiment (not illustrated), the server 590 includes the speech synthesis system 100, and the command processor causes the conversion of a word sequence to a waveform at the server 590, and passes the synthesized waveform to the user interface device 510.

Referring to FIG. 8, a hardware configuration of the device 400 may include a bus 415, which interconnects a memory 435 and a processor 445. The memory may store instructions, which when executed by the processor perform functions described above, including the computations for implementing the artificial neural networks. In addition, the bus may have an audio interface 425 coupled to it, permitting the processor to cause audio input and output to the passed via the microphone 421 and speaker 411, respectively. A network interface 455 may be coupled to be bus for communicating with remove systems, such as the remote system 490.

The training procedures, for example, as illustrated in FIGS. 2 and 3, may be executed on a server computer that has access to the reference waveforms used for training. In some examples, these server computers directly or indirectly pass the trained parameter values to one or more devices 400.

It should be understood that the device 400 is but one configuration in which the speech synthesis system 100 may be used. In one example, the synthesis system 100 shown as hosted in the device 400 may instead or in addition be hosted on a remote server 490, which generates the synthesized waveform and passes it to the device 100. In another example, the device 400 may host the front-end components 422 and 421, with the speech recognition system 430, the speech synthesizer 100, and the processing system 440 all being hosted in the remote system 490. As another example, the speech synthesis system may be hosted in a computing server, and clients of the server may provide text or control inputs to the synthesis system, and receive the enhanced synthesis waveform in return, for example, for acoustic presentation to a user of the client. In this way, the client does not need to implement a speech synthesizer. In some examples, the server also provides speech recognition services, such that the client may provide a waveform to the server and receive the words spoken, or a representation of the meaning, in return.

The approaches described above may be implemented in software, in hardware, or using a combination of software and hardware. For example, the software may include instructions stored on a non-transitory machine readable medium that when executed by a processor, for example in the user interface device, perform some or all of the procedures described above. Hardware may include special purpose circuitry (e.g., Application Specific Integrated Circuits (ASICs), Field Programmable Gate Arrays (FPGAs) and the like) for performing some of the functions. For example, some of the computations for the neural network transformers may be implemented using such special purpose circuitry.

It is to be understood that the foregoing description is intended to illustrate and not to limit the scope of the invention, which is defined by the scope of the appended claims. Other embodiments are within the scope of the following claims.

What is claimed is:

1. A method for automated speech synthesis, said method comprising:

receiving a control input representing a word sequence for synthesis, the control input including a time series of control values representing a phonetic label as a function of time;

generating a first synthesized waveform by processing the control values using a first artificial neural network, the first synthesized waveform including a first degradation associated with a limited number of quantization levels used in determining the first synthesized waveform;

generating a second synthesized waveform by processing the first synthesized waveform using a second artificial neural network, the second artificial neural network being configured such that the second synthesized waveform includes a second degradation, the second degradation being lesser than the first degradation in one or more of a degree of quantization, a perceptual quality, a noise level, a signal-to-noise ratio, a distortion level, and a bandwidth; and providing the second synthesized waveform for presentation of the word sequence as an acoustic signal to a user.

2. The method of claim 1, wherein generating the first synthesized waveform includes, for a sample of the waveform, determining a probability distribution over the limited number of quantization levels according to the control input and selecting the sample of the waveform based on the probability distribution.

3. The method of claim 2, wherein generating the second synthesized waveform includes processing the first synthesized waveform using a convolutional neural network, an input to the convolutional neural network including a plurality of samples of the first synthesized waveform.

4. The method of claim 1, further comprising determining configurable parameters for the second artificial neural network such that samples of a reference waveform are best approximated by an output of the second artificial neural network with a corresponding reference synthesized waveform.

5. The method of claim 4, wherein determining the configurable parameters for the second artificial neural network further includes determining reference control values corresponding to the reference waveform and generating the reference synthesized waveform using the first artificial neural network using the reference control values as input.

6. The method for automated speech synthesis of claim 1, wherein the first synthesized waveform represents a voice speaking a text corresponding to the control input, and wherein further the second synthesized waveform represents a voice speaking the text.

7. A method for automated speech synthesis, said method comprising:

determining a control input representing linguistic characteristics as a function of time corresponding to a word sequence for synthesis;

generating a first synthesized waveform by processing the control values using a first parameterized non-linear transformer;

generating a second synthesized waveform by processing the first synthesized waveform using a second parameterized non-linear transformer; and providing the second synthesized waveform for presentation of the word sequence as an acoustic signal to a user.

8. The method of claim 7, wherein the first synthesized waveform includes a first degradation of a first type of degradation associated with a limited number of quantization levels and wherein the second synthesized waveform includes a second degradation of the first type of degradation, the second degradation being less than the first degradation.

9. The method of claim 7, wherein generating the second synthesized waveform comprises generating the second synthesized waveform to exhibit an improved synthesis characteristic as compared to the first synthesized waveform in one or more of a perceptual quality, a signal-to-noise ratio, a noise level, degree of quantization, a distortion level, and a bandwidth.

10. The method of claim 7, wherein determining the control input comprises receiving the word sequence, forming a phonetic representation of the word sequence, and forming the control input from the phonetic representation.

11. The method of claim 7, wherein generating the first synthesized waveform includes using the first parameterized non-linear transformer to determine a probability distribution over a plurality of quantized levels for a sample of the first synthesized waveform and wherein generating the sample of the first synthesized waveform from the probability distribution includes computing the sample based on the probability distribution.

12. The method of claim 11, wherein computing the sample based on the probability distribution includes selecting the sample to have a highest probability in the probability distribution.

13. The method of claim 7, wherein processing the first synthesized waveform using the second parameterized non-linear transformer includes providing the first sample of the first synthesized waveform as input to a second artificial neural network and generating a first sample of the second synthesized waveform as an output of the second artificial neural network.

14. The method of claim 13, wherein using the second parameterized non-linear transformer further includes providing past samples of the second synthesized waveform as inputs to the second artificial neural network.

15. The method of claim 7, further comprising configuring the second parameterized non-linear transformer with parameter values determined by processing reference waveform data.

16. The method of claim 15, wherein the parameter values are determined by processing the reference waveform data and quantized waveform data corresponding to the reference data such that the second parameterized non-linear transformer is configured to recover an approximation of the reference waveform data from the quantized waveform data.

17. The method for automated speech synthesis of claim 7, wherein the first synthesized waveform represents a voice speaking a text corresponding to the control input, and wherein further the second synthesized waveform represents a voice speaking the text.

* * * * *